United States Patent [19]

Scholes

[11] 4,169,903

[45] Oct. 2, 1979

[54] ELECTROSTATIC PROCESS FOR COATING ELECTRICALLY CONDUCTIVE OBJECTS SUCH AS BEVERAGE CANS

[75] Inventor: Addison B. Scholes, Muncie, Ind.

[73] Assignee: Ball Corporation, Muncie, Ind.

[21] Appl. No.: 805,478

[22] Filed: Jun. 10, 1977

[51] Int. Cl.[2] ..... B05D 1/06

[52] U.S. Cl. ..... 427/28; 118/621; 118/622; 118/627; 427/27; 427/33

[58] Field of Search ..... 427/14, 21, 27, 28, 427/29, 33; 118/621, 622, 624, 627, 629

[56] References Cited

U.S. PATENT DOCUMENTS

| | | | |
|---|---|---|---|
| 2,538,562 | 1/1951 | Gustin et al. | 427/28 |
| 3,113,037 | 12/1963 | Watanabe | 427/33 |
| 3,376,156 | 4/1968 | Whitaker et al. | 118/627 |
| 3,547,078 | 12/1970 | Linneborn | 427/27 |
| 3,593,678 | 7/1971 | Miller | 427/27 |
| 3,904,930 | 9/1975 | Waldron et al. | 427/28 |

*Primary Examiner*—Ronald H. Smith
*Assistant Examiner*—Stuart D. Frenkel
*Attorney, Agent, or Firm*—Cushman, Darby & Cushman

[57] ABSTRACT

The object is electrically charged to have a first polarity. A dispersion in air of powdered coating is similarly charged to have a like, first polarity and is clouded about the object. The metal object is then suddenly provided with an opposite charge to have an opposite, second polarity, whereupon particles from the cloud are uniformly attracted to and deposited on the object. The powder composition and the technique for fusing the deposited powder to provide a continuous coating may be the same as are in current commercial use.

9 Claims, 3 Drawing Figures

ELECTROSTATIC PROCESS FOR COATING ELECTRICALLY CONDUCTIVE OBJECTS SUCH AS BEVERAGE CANS

BACKGROUND OF THE INVENTION

To those familiar with the art of metal can fabrication, it is well known that an inside protective coating is not only desirable, but many times, necessary, depending on the end use of the metal can. Thus, metal cans destined for beverage or food packing are always coated. There are many methods presently in use to effect a coating on the inside surfaces of metal cans. All the present methods of internally coating metal cans have attendant difficulties. Perhaps the greatest of these, by today's standards, is that attendant upon the use of a solvent-based coating material. The need for removal of the solvent following coating application causes a problem. The solvent must be disposed of without causing pollution. Efforts have been made to eliminate solvents from coating materials. Water based coatings have been used. Powder coatings have been used, generally applied by electrostatic means. None of these methods are entirely satisfactory. A powder coating material containing virtually no solvents that could be applied uniformly at high line speeds to inside metal can surfaces would be an ideal solution to this coating problem.

Two general methods are now commercially used in attempting to attain a uniform internal coating using powder material and an electrostatic process.

In the first of these, the powder particles are charged in an intense electrostatic field and then presented to the metal can, which attracts these particles by reason of its opposite charge. Here, the difficulties encountered range from extreme non-uniformity with an excess of the powder clinging to the first available metal surface, such as the rim of the can, to a slow process requiring great attention to controlled air flow transport of the charged powder particles.

In the second of these, the powder particles are charged as they issue, by air transport, from the end of a lance which moves within the metal can to effect the coating. Here, the difficulties arise from both non-uniformity and slow process speed. Once again, in this process, the metal can is of opposite charge to that of the particles, thereby causing the powder to be attracted to its surface.

Among published prior work of others, the U.S. Pat. of Gustin, No. 2,253,562, issued Jan. 16, 1951, teaches a technique for electrostatically coating the inside of a fluorescent glass lighting tube. It does involve a delayed application of electrostatic forces—i.e., electrostatic forces are not applied until after a cloud of powdered coating material is already dispersed within the tube. However, it is also clear that the powder is *not* in an ionized status when it is being distributed within the tube.

Rather, a distinct contrast to the subject invention, non-ionized powdered material is dispersed within the tube and thereafter an electrical potential difference is caused to exist between the hot glass tube (which is an electrical conductor at high temperatures) and an internal central pointed electrode 56. As the point 57 of this electrode is slowly withdrawn along the longitudinal axis of the tube, the powdered coating material is both ionized and then electrostatically attracted to the outer surfaces of the tube in the vicinity of the pointed end 57 of the electrode 56.

Gustin, U.S. Pat. 3,323,489, issued May 22, 1967, teaches an adaptation of the earlier Gustin patented method, this time for coating the inside of glass bulbs.

Other prior U.S. patents of general interest with respect to electrostatic coating of the inside of glass structures, metal structures and/or, generally, the application of powdered particles to surfaces by use of electrostatic forces include:

| Pat. No. | Patentee | Issue Date |
|---|---|---|
| 2,811,131 | Lopenski et al | Oct. 29, 1957 |
| 3,690,298 | Venturi | May 22, 1970 |
| 3,904,930 | Waldron et al | Sept. 9, 1975 |

SUMMARY OF THE INVENTION

The object is electrically charged to have a first polarity. A dispersion in air of powdered coating is similarly charged to have a like, first polarity and is clouded about the object. The metal object is then suddenly provided with an opposite charge to have an opposite, second polarity, whereupon particles from the cloud are uniformly attracted to and deposited on the object. The powder composition and the technique for fusing the deposited powder to provide a continuous coating may be the same as are in current commercial use.

It is one purpose of this invention to provide a process whereby a fine powder may be uniformly applied to the internal surfaces of a metal can. It is a further purpose of this invention to provide an electrostatic coating process in which a fine powder may be uniformly applied to the internal surfaces of a metal can at high line speeds. It is a further purpose of this invention to provide an electrostatic coating process in which a fine powder may be uniformly applied to the internal and/or external surfaces of metal objects, which may include cans, tubes, channels, boxes, and the like. It is a further specific purpose of this invention to provide an electrostatic coating process suitable for the application of an inert-to-beverage lacquer to the inside surface of a beverage container.

The present invention departs from well-known can coating procedures in staging the process in a unique sequence of distinct steps. In brief, powdered coating material is electrostatically charged and thereafter uniformly dispersed within a similarly charged metal container. Subsequently, the electrical potential of the metal container is abruptly changed in value so as to attract the already charged powdered particles to its internal surfaces. In this manner, a more uniform dispersion of the particles is achieved on the internal can surfaces regardless of can configurations.

This invention makes possible the coating of complex-shapes on their interior surfaces. For example, suppose it were desirable to coat the interior of a metal tube of great length compared to its diameter. The electrostatic processes for powder coating heretofore available would not be efficacious. However, by use of the present invention, such a metal tube can be coated by filling it, while charged, with a fine grain air-suspended powder cloud of like charge, and thence discharging the metal tube.

It is now possible, using the process of the present invention, to coat even exterior surfaces of any conceivable metallic complex shape. In such a case, rather than filling the object to be coated with a cloud of the charged coating particles, it is surrounded with the cloud while charged to a like polarity, then suddenly discharged, momentarily, and the coating takes place.

The principles of the invention will be further discussed with reference to the drawing wherein a preferred embodiment is shown. The specifics illustrated in the drawing are intended to exemplify, rather than limit, aspects of the invention as defined in the claims.

DETAILED DESCRIPTION OF THE PRESENTLY PREFERRED EMBODIMENT

Figure 1:
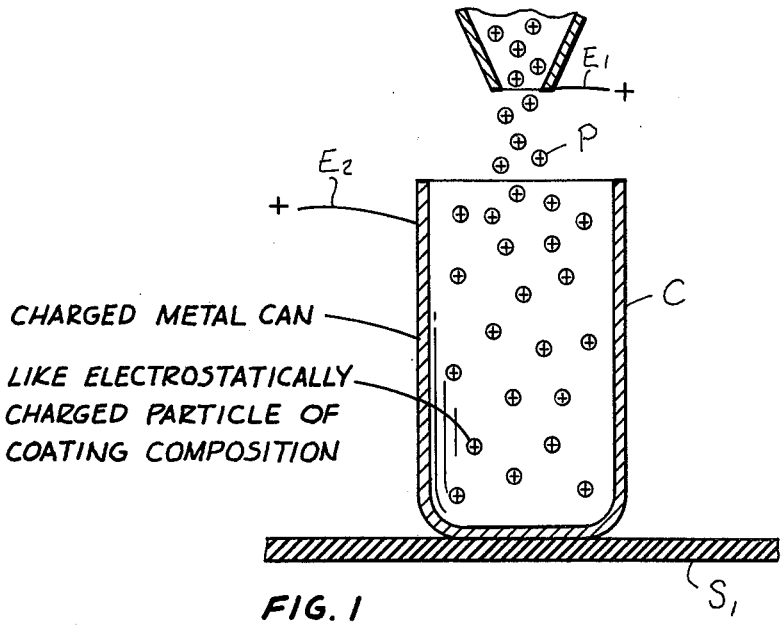
FIGS. 1–3 are diagrammatic views depicting successive stages in providing a can with an internal coating by an electrostatic process in accordance with principles of the present invention.
Figure 2:
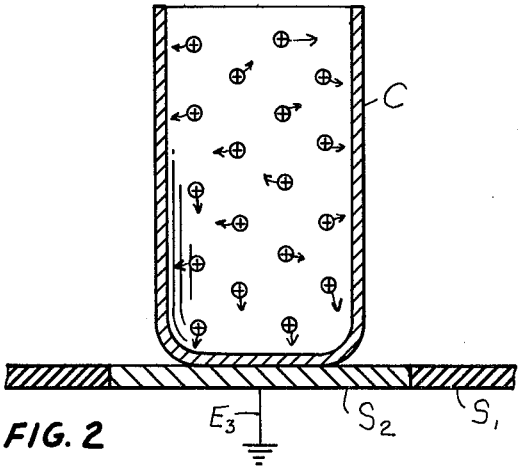
Figure 3:
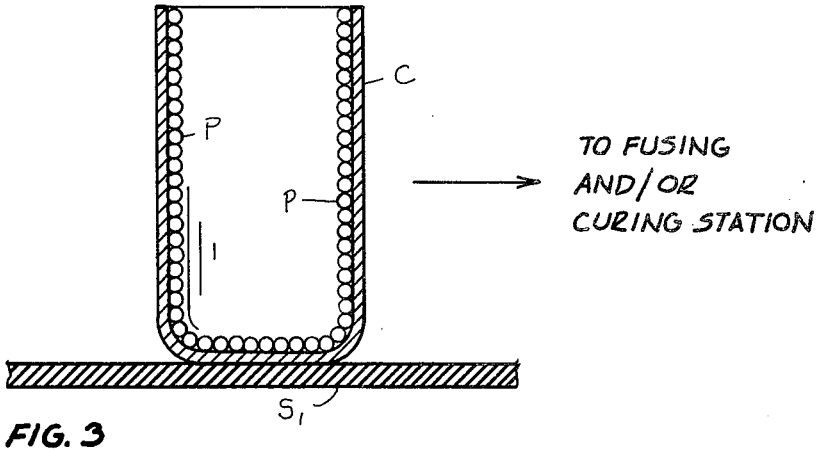

Referring to the drawing figures in succession, fine powder particles P are brought by air transport to the vicinity of one or more electrodes $E_1$, where they acquire an electrostatic charge by means of ion bombardment or diffusion from a corona discharge from the electrodes $E_1$.

The metal can C or other electrically conductive object to be coated, in this instance to be internally coated, is subjected to a high voltage charge by direct contact with a conductor $E_2$ of the same polarity and similar voltage as that applied to the particles P by the electrode $E_1$.

The charged can is supported on an electrically insulated surface $S_1$, e.g., a conveyor of non-conducting plastic material.

The charged powder particles P are air-transported into the charged can C, forming a cloud therein. When the charged can C is sufficiently filled with the charged particles P, the can is discharged by contact with a conductor $E_3$ of substantially different charge than the electrode $E_1$ and the conductor $E_2$. For instance, the conductor $E_3$ may be a grounded metallic surface $S_2$ provided at a discharging station of the conveyor.

Of course, the purpose of the contact at $E_3$ is to substantially change the electrical potential of the can relative to the electrostatic charge of the cloud of particles P filling the can, whereupon the particles will be attracted to and deposited upon the can.

While a single can is shown in the drawing, it should be understood that the process may be carried out as one stage of an automated, continuous, high-speed can-making process.

While the invention was developed primarily for providing metallic beverage cans and/or food cans with a corrosion-resistance, inert coating, generally known as an inert-to-beverage lacquer, clearly the invention may be similarly used to uniformly coat other objects, either inside, or outside or both.

(When the process is used to coat the outside of an object, the charged powder particles are air-transported to the vicinity of the outside of the object, to produce an engulfing cloud. When the cloud surrounds the surfaces that are to be coated, the charged object is contacted by the conductor $E_3$, to cause the particles to deposit on said surfaces.)

Neither the composition of the particles, nor the technique used to fuse and/or cure them to provide a continuous, adherent coating once they are in place, need differ from the respective compositions and techniques in current use in respect to fluidized bed and/or electrostatically applied powder coatings.

It should now be apparent that the electrostatic process for coating electrically conductive objects such as beverage cans as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

A description of typical powder compositions and techniques for curing and/or fusing electrostatically applied powder coatings is found in the following publications:

"Electrostatics and Its Applications" by A. D. Moore—John Wiley & Sons 1973—pages 269–280 (Chapter by Emery Miller) and G. Nicolas "La Samesation", *Surfaces* No. 17 June 1965.

What is claimed is:

1. A process for coating an electrically conductive object comprising:

electrically charging said object to provide it with a charge of a first polarity;

providing a dispersion in air of particles of powdered coating material;

providing said particles with an electrostatic charge of said first polarity and similar magnitude to that of said charged object;

clouding said charged particles about such portion of the charged object as is to be coated thereby;

suddenly substantially changing at least the magnitude of said charge of said object while said charged particles surround said portion of the object to be coated, whereupon said charged particles are attracted to and are deposited upon said portion of said object.

2. The process of claim 1, wherein:

said object is a beverage can made of metal and said powdered coating material is an inert-to-beverage lacquer for internally coating said can.

3. The process of claim 1, wherein:

said step of changing said charge on said object is accomplished by engaging said object with a discharging electrode.

4. The process of claim 1, wherein:

said object is hollow so as to have a cavity and said clouding is accomplished by propelling said charged particles into said cavity.

5. The process of claim 1, wherein:

said portion of said object to be coated is exposed exteriorly of said object and said clouding is accomplished by propelling said charged particles into the vicinity of said exteriorly exposed portion.

6. An electrostatic coating process for coating an electrically conductive object with ionized coating particles, said method comprising the steps of:

clouding said ionized coating particles into the near proximity of said object to be coated while said object is maintained at an electrical potential substantially similar to that of said ionized coating particles; and thereafter abruptly altering the electrical potential of said object whereupon said substantially uniformly dispersed ionized coating particles are attracted to and deposited upon said object in a substantially uniform coating layer.

7. The process of claim 6 wherein said object is a metal can and said coating material is a powdered coating material for internally coating said can.

8. The process of claim 6 wherein said step of abruptly altering the electrical potential of said object is accomplished by engaging said object with a discharging electrode.

9. The process of claim 6 wherein said object is hollow so as to have a cavity and said clouding is accomplished by propelling said ionized coating particles into said cavity.

* * * * *